US005899057A

United States Patent [19]

Schuller et al.

[11] Patent Number: 5,899,057

[45] Date of Patent: May 4, 1999

[54] OPENER ROLLER FOR AN OPEN-END SPINNING DEVICE

[75] Inventors: Edmund Schuller, Ingolstadt; Eva-Maria Greppmair, Peutenhausen; Claus Franz, Ingolstadt, all of Germany

[73] Assignee: Rieter Ingolstadt Spinnereimaschinenbau AG, Ingolstadt, Germany

[21] Appl. No.: 08/990,036

[22] Filed: Dec. 12, 1997

Related U.S. Application Data

[63] Continuation of application No. 08/657,687, May 31, 1996, Pat. No. 5,794,311.

[30] Foreign Application Priority Data

Jun. 7, 1995 [DE] Germany ..... 195 20 346

[51] Int. Cl.[6] ..... D01H 4/00

[52] U.S. Cl. ..... 57/408; 19/100; 19/112; 19/114; 57/416

[58] Field of Search ..... 57/406, 408; 19/97, 19/100, 112, 114

[56] References Cited

U.S. PATENT DOCUMENTS

| | | | |
|---|---|---|---|
| Re. 32,507 | 9/1987 | Schmid et al. . | |
| Re. 33,190 | 4/1990 | Stahlecker . | |
| 2,849,844 | 9/1958 | Snape, Jr. . | |
| 3,264,690 | 8/1966 | Morrill . | |
| 3,800,520 | 4/1974 | Schiltknecht . | |
| 4,067,625 | 1/1978 | Goldammer . | |
| 4,163,304 | 8/1979 | Laflaquiere et al. . | |
| 4,196,496 | 4/1980 | Stauffer et al. . | |
| 4,208,767 | 6/1980 | Schmolke . | |
| 4,296,527 | 10/1981 | Eadie . | |
| 4,300,265 | 11/1981 | Heinen . | |
| 4,352,224 | 10/1982 | Grimshaw et al. . | |
| 4,435,953 | 3/1984 | Schmid et al. . | |
| 4,679,390 | 7/1987 | Stewart . | |
| 4,805,395 | 2/1989 | Stahlecker et al. . | |
| 4,894,983 | 1/1990 | Schmid . | |
| 5,085,047 | 2/1992 | Hofmann . | |
| 5,497,610 | 3/1996 | Rottmayr . | |
| 5,689,946 | 11/1997 | Schmid | 57/408 |
| 5,709,074 | 1/1998 | Stahlecker | 19/114 |
| 5,768,880 | 6/1998 | Schmid | 57/408 |

FOREIGN PATENT DOCUMENTS

| | | |
|---|---|---|
| 436754 | 7/1991 | European Pat. Off. . |
| 4039634 A1 | 6/1992 | Germany . |
| 661535 | 7/1987 | Switzerland . |

*Primary Examiner*—William Stryjewski
*Attorney, Agent, or Firm*—Dority & Manning

[57] ABSTRACT

For an opener roller for an open-end spinning device provided with a basic body by which it is connected to a supported shaft for rotatable support, it is proposed that the clothing be attached to the basic body via a clothing holder, whereby fasteners are used. For the fixed allocation of the clothing holder to the basic body it is provided that the attachment of the clothing holder by means of the fasteners be effected from the side of the opener roller which is facing the shaft bearing. The face of the opener roller away from the shaft covers the shaft, so that this face of the opener roller is also an even surface.

7 Claims, 4 Drawing Sheets

OPENER ROLLER FOR AN OPEN-END SPINNING DEVICE

This application is a continuation of Ser. No. 08/657,687, filed May 31, 1996, now U.S. Pat. No. 5,794,311.

BACKGROUND OF THE INVENTION

The present invention relates to an opening roller for an open-end spinning device. Opener rollers are used with open-end spinning devices to separate the fibers to be spun and which are fed to the opener roller in the form of a fiber sliver. It rotates at high speed and with its clothing, consisting of teeth or needles, it separates individual fibers, which are then fed to a spinning element, from the fiber sliver. The clothing of an opener roller is in fact not suitable for all fiber materials, so that when a spinning machine is changed over to a new type of material, the opener roller or its clothing must be replaced. The clothing is furthermore subject to wear, so that replacement of the clothing is also required for this reason. In the state of the art different embodiments of an opener roller are known, whose clothing is replaceable. The opener roller is installed on a shaft which is supported by a bearing, so that the opener roller is designed to be rotatable in this manner, whereby at least a part of the opener roller which is made up of several parts is connected to the shaft. This connection is usually effected by means of a press fit.

DE-OS 25 28 485 discloses the possibility of making the clothing of the opener roller in several parts for the purpose of replaceability, whereby it consists of a basic body which is connected to a shaft by means of a press fit and whereby the clothing is installed on the opener roller by means of a clothing holder in such a manner that a secure coordination between basic body and clothing holder is ensured. It is impossible for the clothing to come loose or to rotate. For this purpose, fasteners, e.g. in the form of screws are provided which reach through an opening in the clothing holder all the way into the basic body. These fasteners are located on the face of the opener roller which is located on the side away from the bearing of the opener roller. This design has the disadvantage that surface of this face is roughened by the fasteners. Fiber particles can be caught there and accumulate, and then become loose again, causing faulty spots in the yarn. It is also a disadvantage that the shaft extends into the face.

It is a known method to make the face of the opener rollers as much as possible without edges, but the solutions proposed are not very satisfactory. U.S. Pat. No. 4,296,527 discloses an embodiment which does not use fasteners. For this, the basic body and the clothing holder are designed so as to become attached to each other via threads, for example. Another embodiment is also shown here, in which the clothing holder is attached by means of a screw to the opener roller on the face away from the bearing. Thus the second embodiment resembles also that of DE-OS 25 28 485. The first embodiment mentioned has the disadvantage that its manufacture is expensive, or that the connection between basic body and clothing holder is either not secure enough, or the connection is difficult to disconnect.

Patent CH 661 535 A5 discloses another opener roller whose clothing holder is attached without fasteners. To accomplish this, it is shrink-fitted as the basic body on the shaft. This has the disadvantage that a replacement of the clothing is time-consuming. Besides, the shaft on which the opener roller is supported may be damaged from the repeated installation of a press-fit.

OBJECTS AND SUMMARY OF THE INVENTION

It is therefore a principal object of the present invention to design an opener roller for an open-end spinning machine in such a manner that the clothing can be exchanged easily and rapidly, with a simple construction and fasteners, and with the opener roller designed and the fasteners placed in such a manner that the yarn quality is not affected. Additional objects and advantages of the invention will be set forth in part in the following description, or may be obvious from the descriptions or may be learned through practice of the invention.

The invention is based on the realization that it is not sufficient to make the fasteners as much as possible free of edges, but surprisingly also that it matters on which of the two faces of the opener rollers the fasteners are located. In further development of the opener roller housings for opener rollers of open-end spinning machines, the state of the art provided in the meantime for the fiber to be conveyed not only as before, exclusively in the circumferential sense in the area of the clothing, but for certain applications of the fibers, provided also the possibility of taking a direction in the opener roller housing which guides them along the face of the opener roller. The fibers were conveyed here along the face of the opener roller which is away from the bearing. This realization has led to new standards against which the development of opener rollers is measured.

The movement of the fibers in the opener roller housing as described above is described in the German patent application P 43 41 411.7-26. The result of the design of the opener roller according to the invention is that the face of the opener roller away from the bearing can be an even surface which has no raised areas, depressions, or other edges on which fibers may catch. Thanks to this design, this opener roller can also be used in open-end spinning machines having improved fiber conveying in the opener roller housing. Thanks to the utilization of fasteners expensive embodiments of basic body and clothing holder which can be connected to each other through their own form can be dispensed with, and the less costly type of attachment, e.g. with screws, can be used. This has at the same time the advantage that it can be serviced more easily and, at the same time, ensures secure connection of basic body and clothing holder, covering the shaft also in a simple manner.

It is especially advantageous if the basic body is designed so that it contains the face towards the bearing, as this makes it possible to exchange the clothing holder easily because it need not be moved beyond the bearing. The danger of damage to the clothing during its replacement is thereby reduced. Furthermore, the bore of the hub of the basic body can thus go all the way through, rendering its machining easier, and the shaft can be covered simply by the clothing holder.

However it may also be advantageous for the clothing holder to contain the face towards the bearing, in particular if the clothing holder interacts with a ring-shaped clothing support. In that case, the opener roller can be placed on its face away from the bearing for disassembly, the clothing holder can then be removed, and the ring-shaped clothing support can then be removed. This simple manipulation considerably reduces the danger of damaging the clothing. The basic body then covers the shaft with its face away from the bearing.

It is especially advantageous for the basic body or clothing holder to be designed so as to contain an opening for a fastener, whereby the opening may be a bore extending parallel to the shaft on which the opener roller is mounted. If the basic body has the opening, the fastener, e.g. a screw, is inserted through it and extends all the way into the clothing holder where the threads for this screw are located. The reverse is analogous where, in another embodiment of the opener roller, the clothing holder has the opening through which the fastener is inserted which then ends in the threads of the basic body.

In an especially advantageous embodiment of the opener roller, the clothing holder is configured so that it has an essentially cylindrical mantle surface which is approximately as wide as the clothing in the axial direction and this clothing is installed on the mantle surface of the clothing holder. This may be accomplished by means of a toothed wire for example, or e.g., also by means of a firmly press-fitted clothing support which may be provided with needles or teeth.

In another advantageous embodiment of the clothing holder, the latter is provided with a seat by means of which a ring-shaped clothing support is radially supported.

In another advantageous embodiment of the clothing holder, the latter is provided with a stop which bears axially upon a clothing support and thus holds it against the basic body. In that case, it is also possible for the clothing holder to be provided with a seat as well as with a stop.

In an advantageous embodiment of the fastener, the latter is made in form of screws, it being especially advantageous for them to be placed at even distances from each other. It is especially advantageous here to see to it that the distribution of mass on the opener roller is uniform, so as to avoid imbalance in its running. It is also possible to consider one single fastener if provisions are made for the opener roller to be balanced. Advantageously, three screws are used for the connection between basic body and clothing holder. If countersunk head screws are used, these have the advantage of only minimally disturbing the evenness of the face through which they are inserted if they are suitably designed.

An embodiment of the opener roller in which the threads for the screw are located in the clothing holder is especially advantageous, because in this case the opener roller is provided with new threads each time the clothing holder is replaced. Since the clothing holder is often made of aluminum, fastening is always equally easy even in case of frequent replacement of the clothing, since the fasteners are able to interact with unused threads.

In an especially advantageous embodiment, the clothing holder is provided with an axial bore which is closed by a cover during operation of the opener roller. This cover is inserted into the clothing holder in such a manner that this face of the opener roller practically constitutes a completely flat surface. This is because if the clothing holder has this axial bore, and in case that the clothing is coated in its manufacture, several clothing holders can be supported on one support thanks to this axial bore, so that coating can be rendered simpler and less costly. It is especially advantageous when the cover is disassembled, as the interior of the opener roller can then be cleaned without having to disassemble the clothing holder.

For the installation of clothing holder on the basic body, it is advantageous to provide an adjusting device on the opener roller which makes it easier during assembly to align the openings through which the fasteners, e.g. screws, are inserted exactly with the appertaining threads, so that the latter need not first be located. For this purpose a stop is provided which signals the correct position of clothing holder relative to the basic body. If the stop interacts with a helicoidal edge on the basic body, this has the advantage that the clothing holder can be set on the basic body and is then rotated until the stop fits inside. Further rotation in the same direction causes the stop to be brought into its end position which then indicates correct alignment. A helicoidal edge has the advantage here, that if rotation is effected in the wrong direction, no abrupt stopping occurs, but merely increasingly difficult rotation and finally jamming. It is especially advantageous for at least the face of the opener roller away from the bearing to be provided with a helicoidal hub which is placed so that air is conveyed radially outward from the area of the axis of rotation of the face as a result of the rotation of the opener roller.

In an advantageous further development, at least the clothing holder is to be an extruded component. Thereby a non-porous surface can be produced, so that the component can be coated at especially low cost.

DETAILED DESCRIPTION OF THE PREFERRED EMBODIMENTS

Figure 1:
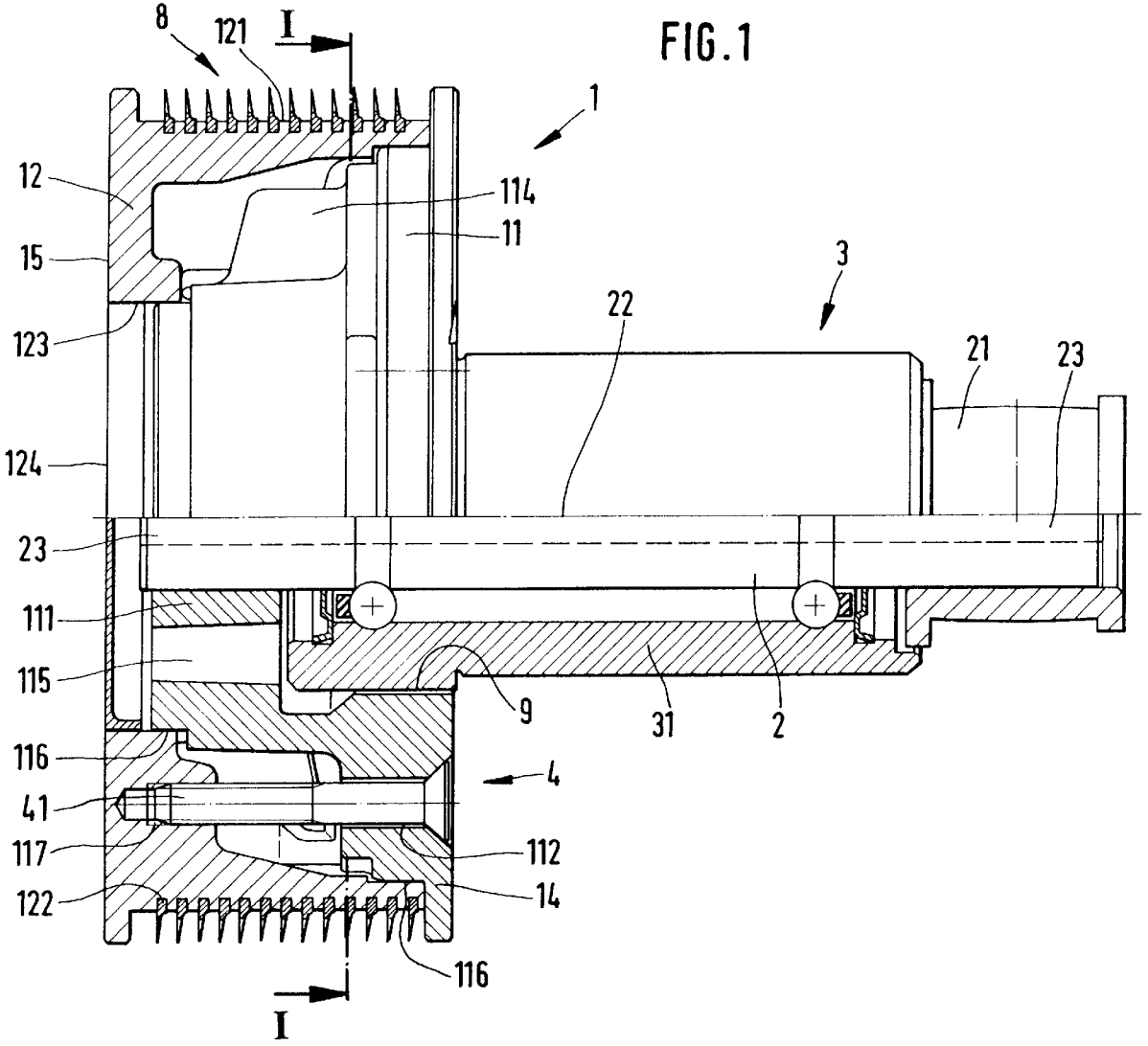
FIG. 1 shows an opener roller with its bearing, partly in a section

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present invention cover such modifications and variations as come within the scope of the appended claims and their equivalents.

The opener roller 1 of FIG. 1 is mounted on a shaft 2 which is supported in a bearing 3. On its side away from the opener roller 1, the shaft 2 is provided with a wharves 21 via which the opener roller is driven by means of a belt. The opener roller 1 itself, which is shown in the lower half of the drawing in a section, consists of a basic body 11 and a clothing holder 12. The clothing holder 12 is connected to the basic body 11 through a fastener 4 in the form of a screw 41. The basic body 11 has a hub 111 which is pressed on shaft 2 by means of a press-fit. The basic body 11 has an opening 112 in the form of a bore through which the screw 41 is inserted and extends all the way into the clothing holder 12 where it interacts with threads 117. The opening 112 extends parallel to axis 22 of shaft 2. The clothing holder 12 is attached according to the invention on the side of the face 14 of opener roller 1 towards the bearing 3. This means that the surface of the face towards the bearing is interrupted because the fastener 4 extends through its surface. However, because the screw 41 is in the form of a countersunk head screw, the disturbance of the evenness and smoothness of the surface of face 14 is kept at a minimum.

The opening 112 is countersunk in the area of face 14 to receive the countersunk head screw 41. To increase the stability of the basic body 11, and in particular of its hub 111, it is reinforced by means of ribs 114. It is especially advantageous for the basic body 11 to be provided with air ducts 115. Shaft 2 is provided with a bore 23 parallel to its axis so that the air duct 115 is connected via bore 23 with the outside air, i.e. the air outside an opener roller housing. This has the advantage that the sealing gap 9 between the basic body 11 and the sleeve 31 of bearing 3 is connected to the outside air. As a result, air is able to flow through bore 23 through the air duct 115 and into the area in front of the face 14 towards the bearing. The result of this is that the interior of the opener roller is kept free of fibers and dirt which would otherwise reach the interior through the sealing gap 9 and could soil the ball bearing of shaft 2, for example, or could accumulate to such an extent that a rotation of the basic body relative to sleeve 31 of bearing 3 is no longer possible. Penetration of dirt or fibers into the opener roller can occur in the particular in case of unfavorable pressure conditions in the opener roller housing.

The basic body 11 is provided with a receiving surface 116 through which the clothing holder 12 is centered on the basic body 11. The clothing holder 12 is provided with a cylindrical mantle surface 121 having an axial length equal to the width of the clothing 8 installed on the mantle surface. The clothing holder 12 is made in one piece with the cylindrical mantle surface 121, and this provides an especially favorable and simple embodiment. The cylindrical mantle surface 121 is provided with grooves 122 into which the foot of the clothing wire is press-fitted. The face 15 of opener roller 1 away from bearing 3 is here constituted by the clothing holder 12.

It is also conceivable, in another embodiment of the basic body 11, that the latter extend as far as into the plane of the face 15 away from the bearing 3, so that this face would be constituted in part by the basic body 11 and in part by the clothing holder 12. This would however have the disadvantage that a gap would be produced between the two into which dirt caused by fibers could accumulate and lead to interference with the spinning operation. It is however a special advantage over the state of the art, in this embodiment, that the shaft does not reach into the plane of the face 15 towards the bearing 3 but is covered by the basic body 11 or the clothing holder 12. This is because the end of shaft 2 is especially conducive to the accumulation of fibers. The clothing holder 12 of FIG. 1 is provided with an axial bore 123 which is closed by cover 124 so that the face 15 away from bearing 3 is completely even, whereby the transition between cover 124 and the clothing holder 12 has so insignificant a gap that it cannot lead to interference with the spinning operation. The axial bore 123 is provided in order to facilitate the handling of the clothing holder 12 during its manufacture. Especially if the clothing 8 is coated, the presence of axial bores 123 make it possible to thread several clothing holders 12 on a mandrel so that they may be coated together.

In the embodiment of FIG. 1 the basic body 11 is provided with the face 14 towards bearing 3. It would however be just as possible to design the basic body so that it be provided with the face 15 away from bearing 3. This has the corresponding consequence that the clothing holder would be provided with the face 14 towards bearing 3. During assembly or disassembly the clothing holder would then have to be brought to the basic body via bearing 3. The basic body would then correspondingly be provided with the threads into which the screws are screwed in, and the clothing holder would be provided with an opening for the insertion of the screw. The embodiment shown in FIG. 1 has the advantage over this embodiment that whenever the clothing holder 12 is replaced, new threads 117 are used each time. Since the opener roller is most often made of aluminum which is not very hard and could wear out the threads faster, this is especially advantageous.

Figure 2:
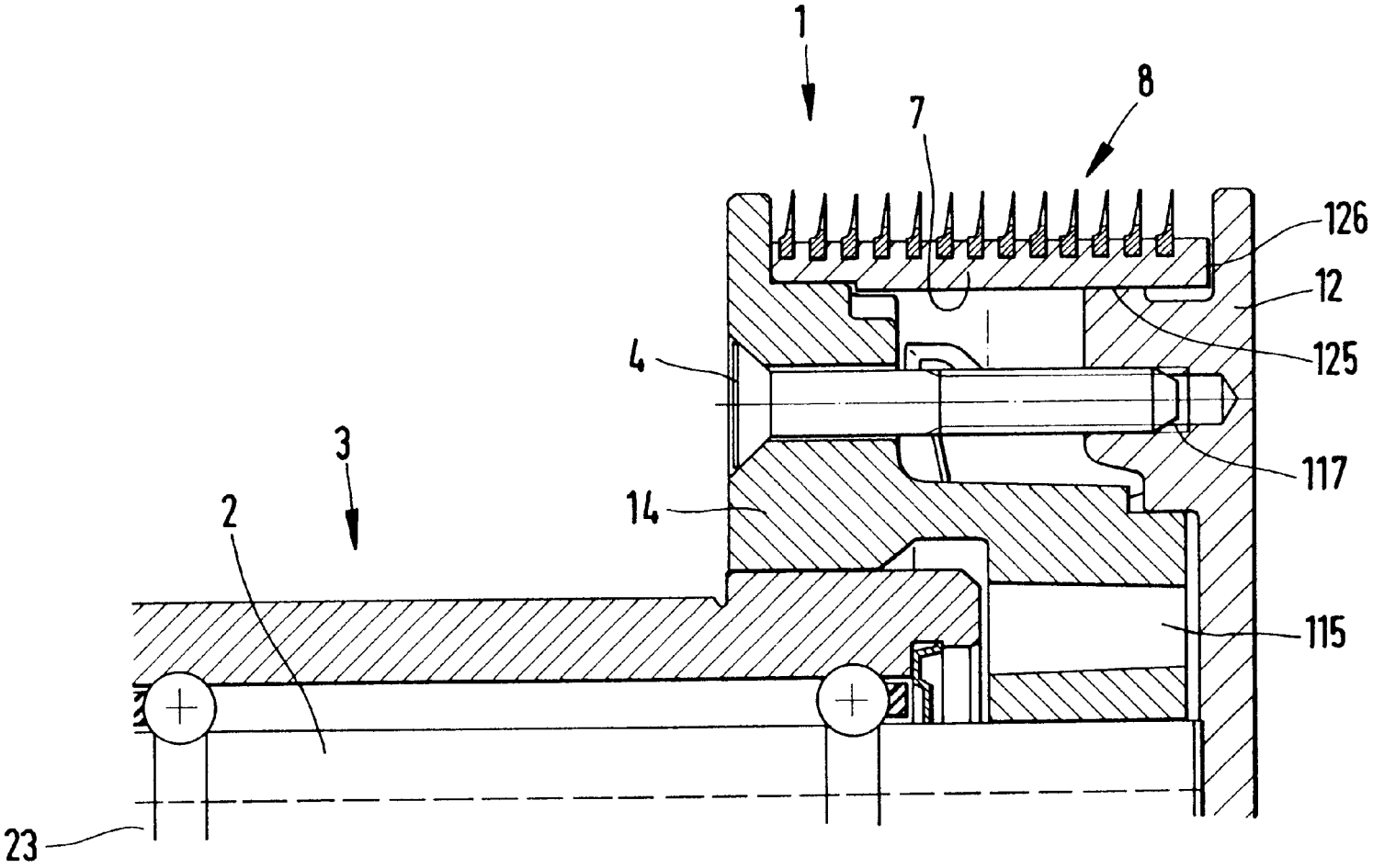
FIG. 2 is a partial representation of an opener roller in section, with a ring-shaped clothing support.

The opener roller partially shown in a section in FIG. 2 also contains a fastener 4 by means of which the face 14 towards bearing 3 is attached. The opener roller of FIG. 2 has however a ring-shaped clothing support 7 which is connected to the basic body 11 by means of the clothing holder 12 and the fastener 4. The clothing holder 12 is provided with a seat 125 which holds the ring-shaped clothing support radially. At the same time the clothing holder 12 is provided with a stop 126 which holds the ring-shaped clothing support 7 axially. In the embodiment shown in FIG. 2, the clothing support 7 is provided with a clothing 8 consisting of a mounted clothing wire. The clothing support 7 can however be provided with a clothing which is cut from the solid block, e.g. which is ground out of the clothing support 7. It is of course equally possible to use clothing supports 7 equipped with needles. By contrast with the embodiment of FIG. 1, the clothing holder 12 is not provided with an axial bore (123, FIG. 1) To convey air through the bore 23 of shaft 2 in the area of the clothing holder 12, the latter is provided with a air-guiding groove (not shown) so that the air duct 115 of the basic body 11 is connected via bore 23 of shaft 2 to the outside air.

Figure 3:
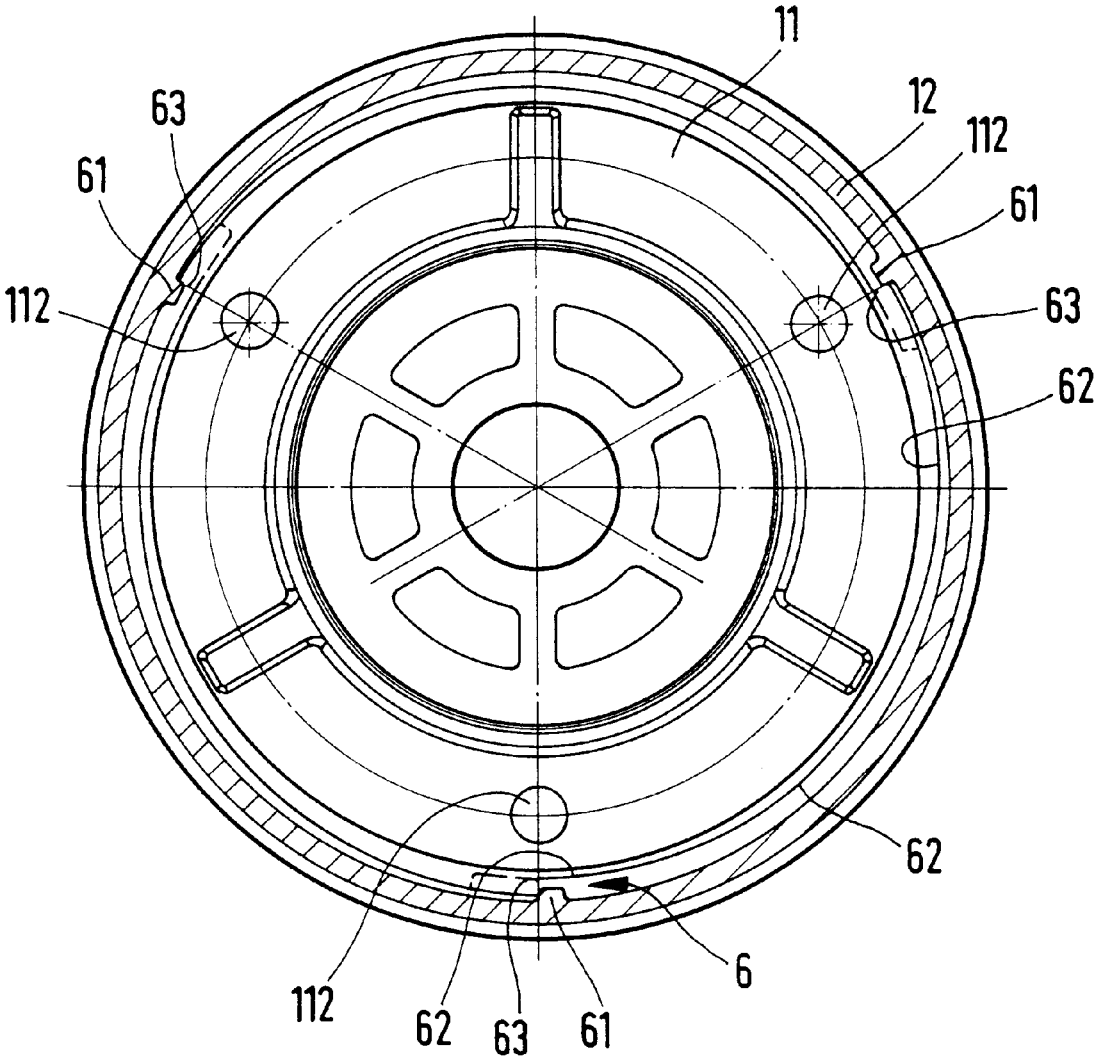
FIG. 3 is a top view of the basic body with a cut-away representation of the clothing holder and FIG. 4 is a top view of the face of an opener roller away from the bearing

FIG. 3 shows a top view of the opener roller of FIG. 1 from the side away from bearing 3, whereby the clothing holder is shown in a cutaway in the area of line A—A of FIG. 1. The adjusting device consists essentially of an adjusting stop 61 which is installed on the clothing holder 12 and of an edge 62 which is formed on the basic body 11. The edge 62 is in the form of a helicoidal line deviating slightly from a circular line, with the center in the center of the opener roller. The opener roller of FIG. 3 is provided with three such helicoidal edges 62 and the clothing holder 12 correspondingly with three adjusting stops. At the beginning or end of each helicoidal edge 62 a shoulder 63 is produced due to the changed distance from the edge 62 to the center, whereby the adjusting stop 61 impacts against this shoulder 63 to adjust the clothing holder relative to the basic body 11. The helicoidal form of edge 62 has the advantage that when the clothing holder 12 is mounted on the basic body 11, the adjusting stop 61 is generally to be found in an area in which the distance from the adjusting stop 61 to the center of the opener roller is smaller than the distance to the edge 62. This means that the clothing holder 12 does not catch on the basic body 11. Only by rotation of the clothing holder 12 to the right relative to the basic body 11 does the adjusting stop 61 arrive in an area in which a clearance exists between the adjusting stop 61 and the edge 62, so that the clothing holder is seated on the basic body 11. In order to bring the threads (117, FIG. 1) into alignment with the opening 112, the clothing holder 12 only needs to be rotated further in the same direction, until the adjusting stop 61 of the clothing holder 12 impacts the shoulder 63 of the basic body 11. In the embodiment of FIG. 3, three shoulders 63 exist and have the advantage that when the clothing holder 12 is placed on the opener roller 1, the latter does not jam as readily. It is also possible to operate with fewer shoulders or adjusting stops.

Figure 4:
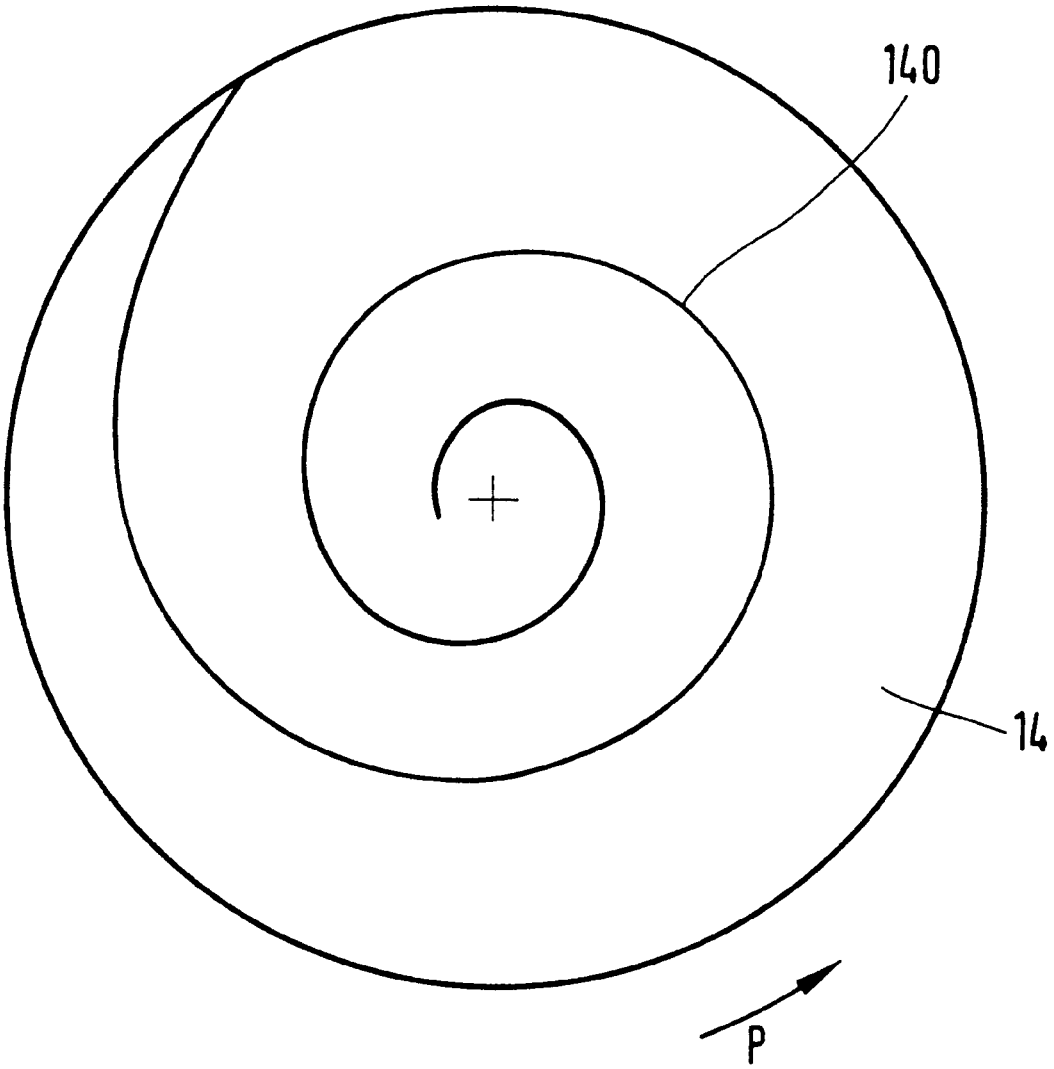

FIG. 4 shows a top view of the face 14 of the opener roller away from the bearing. In this embodiment the face 14 is provided with a helicoidal groove 140 which is used to convey air from the area of the rotational axis of the opener roller radially to the outside when the opener roller rotates. The helicoidal groove 140 need not extend to the center of face 14 in this case. It is sufficient if a curved groove 140 is provided at least in the outer area of face 14, suitable to convey air radially to the outside when the opener roller is used (arrow P). Such a shorter groove, not shown in FIG. 4, is especially suitable for the face of the opener roller towards the bearing. In the design of groove 140, care must be taken that it does not have edges on which fibers could settle.

In the description of the present invention, screws in particular were described as fasteners. It is however also possible to use a bayonet-type closure.

It will be apparent to those skilled in the art that various modifications and variations can be made in the invention without departing from the scope and spirit of the invention. It is intended that the present invention cover such modifications and variations as come within the scope of the appended claims and their equivalents.

We claim:

1. An opener roller for an open end spinning machine, comprising:

a base body having an opening therein for attachment with a shaft which is mounted in a bearing device for rotatable support of said opener roller;

a clothing support member mounted on said base body and having a longitudinally extending cylindrical outer circumferential surface with card clothing attached to said outer circumferential surface;

a first axial face configured on said base body and facing said bearing, and a second axial face opposite said first axial face, said card clothing disposed between said first and second axial faces, said second axial face defined by a member other than said base body having a bore defined therethrough coaxial with said shaft; and a removable cover component configured to cover said bore so that said second axial face and said cover component are essentially flush and extend in generally the same plane.

2. The opener roller as in claim 1, wherein said clothing support member comprises a clothing holder, said clothing holder comprising a cylindrical section and an axial end that further defines said member defining said second axial face with a bore defined therethrough.

3. The opener roller as in claim 1, wherein said clothing support member comprises a cylindrical member housed between said first axial face and said member defining said second axial face.

4. The opener roller as in claim 1, wherein said base body defines said first axial face.

5. The opener roller as in claim 1, further comprising attaching devices extending through said first axial face and into said member defining said second axial face to hold said member and said clothing support member relative to said base body.

6. The opener roller as in claim 5, wherein said clothing support member comprises a cylindrical section and an axial end formed integral therewith that also defines said member defining said second axial face with a bore defined therethrough.

7. The opener roller as in claim 1, wherein said cover component has an uninterrupted flat planar surface.

* * * * *